United States Patent [19]

Naya et al.

[11] Patent Number: 4,626,282

[45] Date of Patent: Dec. 2, 1986

[54] CONTACT MATERIAL FOR VACUUM CIRCUIT BREAKER

[75] Inventors: Eizo Naya; Mitsuhiro Okumura, both of Amagasaki, Japan

[73] Assignee: Mitsubishi Denki Kabushiki Kaisha, Tokyo, Japan

[21] Appl. No.: 792,983

[22] Filed: Oct. 30, 1985

[30] Foreign Application Priority Data

Oct. 30, 1984 [JP] Japan ..... 59-230619
Nov. 20, 1984 [JP] Japan ..... 59-247517

[51] Int. Cl.[4] ..... B22F 1/00

[52] U.S. Cl. ..... 75/247; 419/48; 200/144 B; 200/265; 200/266; 200/270; 252/512; 335/6

[58] Field of Search ..... 200/144 B, 265, 266, 200/270; 75/247; 419/48; 252/512; 335/6

[56] References Cited

U.S. PATENT DOCUMENTS 4,128,748 12/1978 Lafferty ..... 200/144 B
4,546,222 10/1985 Watanabe et al. ..... 200/144 B
4,551,596 11/1985 Watanabe et al. ..... 200/144 B

*Primary Examiner*—Stephen J. Lechert, Jr.
*Attorney, Agent, or Firm*—Lowe, Price, LeBlanc, Becker & Shur

[57] ABSTRACT

Contact material for vacuum circuit breaker according to the present invention contains (1) copper, (2) molybdenum, and (3) niobium or tantalum.

7 Claims, 6 Drawing Figures

CONTACT MATERIAL FOR VACUUM CIRCUIT BREAKER

BACKGROUND OF THE INVENTION

1. Field of the Invention

The present invention relates to a vacuum circuit breaker which is excellent in high current breaking characteristics, and more particularly, it relates to contact material for the same.

2. Description of the Prior Art

Vacuum circuit breakers, which are maintenance-free, pollution-free and excellent in breaking performance, have been widely used in the art. With development thereof, awaited is provision of circuit breakers applicable to both higher voltage and higher current.

Performance of a vacuum circuit breaker mainly depends on contact material for the same. Such contact material is preferable to have (1) larger breaking capacity, (2) higher withstand voltage, (3) lower contact resistance, (4) smaller force required to separate welded contacts, (5) smaller contact consumption, (6) smaller chopping current, (7) better machinability and (8) sufficient mechanical strength.

It is practically difficult to obtain a contact material having all of the said preferable characteristics. In practical contact material, therefore, only particularly important characteristics required for a specific use are improved at the sacrifice of the other characteristics. For example, a copper (Cu) - tungsten (W) contact material as disclosed in Japanese Patent Laying-Open Gazette No. 78429/1980 is excellent in withstand voltage performance, and thus commonly applied to load switchs, contactors etc. However, the Cu-W contact material is not so much satisfactory in current breaking performance.

On the other hand, a copper (Cu) - chromium (Cr) contact material disclosed in, e.g., Japanese Patent Laying-Open Gazette No. 71375/1979 is remarkably excellent in breaking performance, and thus commonly applied to circuit breakers etc. However, the Cu-Cr contact material is inferior in withstand voltage performance to the Cu-W contact material.

In addition to the aforementioned examples, examples of contact materials generally used in the air or oil are described in literature such as "General Lecture of Powder Metallurgy" edited by Yoshiharu Matsuyama et al. and published (1972) by Nikkan Kōgyo Shinbun. However, such contact materials of silver (Ag) - molybdenum (Mo) and Cu-Mo systems as described in "General Lecture of Powder Metallurgy" pp. 229–230 are inferior in withstand voltage performance to the aforementioned Cu-W contact material as well as in current breaking performance to the said Cu-Cr contact material, and thus are scarcely applied to vacuum circuit breakers at present.

As mentioned above, practically selected and employed is a contact material which is excellent in characteristics required for a specific use. However, desired in recent years are vacuum circuit breakers which are applicable to both higher current and higher voltage, and it is difficult to satisfy characteristics required therefor by a conventional contact material. Further, a contact material having higher performance is desired also for miniaturizing the vacuum circuit breakers.

SUMMARY OF THE INVENTION

Accordingly, an object of the present invention is to provide contact materials for the vacuum circuit breaker which are excellent in breaking performance with improvement in characteristics.

The contact material for the vacuum circuit breaker according to the present invention comprises (1) copper, (2) molybdenum and (3) niobium (Nb) or tantalum (Ta).

The above and other objects, features, aspects and advantages of the present invention will become more apparent from the following detailed description of the present invention when taken in conjunction with the accompanying drawings.

DESCRIPTION OF THE PREFERRED EMBODIMENTS

Preparation of Contact Material

Figure 1A:
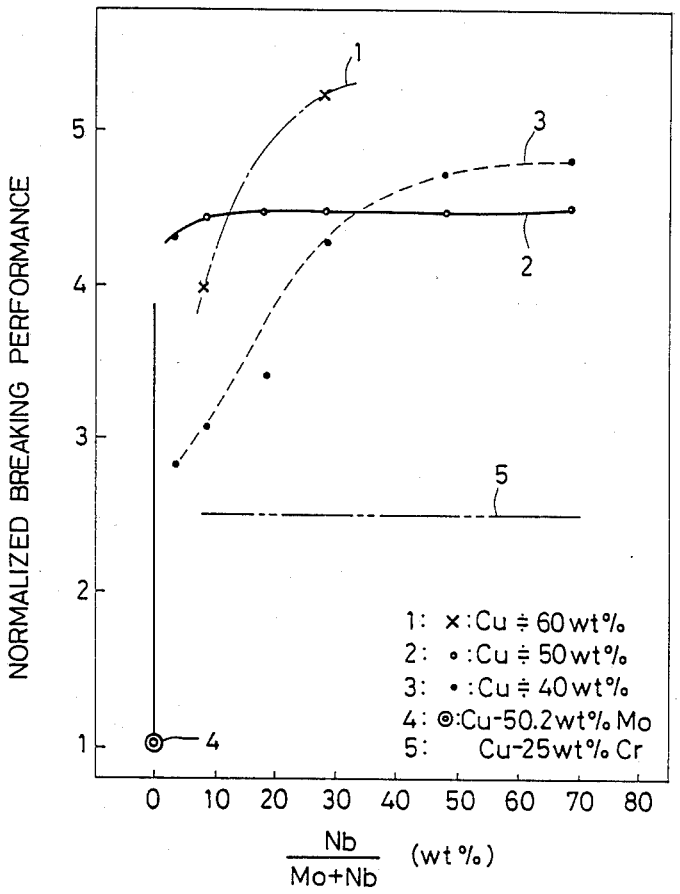
FIGS. 1A and 1B are graphs respectively showing normalized breaking performance of Cu-Mo-Nb and Cu-Mo-Ta contact materials prepared by an infiltration method in accordance with the present invention.

Three sample groups of contact materials were prepared by three methods of applied powder metallurgy, i.e., an infiltration method, a powder sintering method and a hot press method.

In the infiltration method, for example, Mo powder of 3 μm in mean grain size, Nb powder of grain size less than 40 μm and Cu powder of grain size less than 40 μm have been mixed in the ratio of 75.7:7.8:16.5 at weight percentage (wt. %) for two hours. The mixed powder was then filled in dies of prescribed geometry, to be compacted by a press under a pressure of 1 ton/cm$^2$. The compact thus formed has been sintered at 1000° C. for two hours in a vacuum, thereby to obtain loosely sintered compact. A block of oxygen-free copper was placed on the loosely sintered compact, which were then kept at 1250° C. for one hour in a hydrogen atmosphere, to obtain a contact material impregnated with oxygen-free copper. The final composition of this contact material is that of a sample 2N as shown in Table 1A. Table 1A lists up the samples of the Cu-Mo-Nb system prepared by the infiltration method, in which a sample 1R containing no Nb was prepared for reference.

Similarly, Table 1B shows samples of the Cu-Mo-Ta system prepared by the infiltration method under the same processing conditions as above.

TABLE 1A

| Sample | (Infiltration Method) Composition (wt. %) | IACS (%)* |
|---|---|---|
| 1R | Cu—50.2Mo | 60.5 |
| 2N | Cu—31.3Mo—3.7Nb | 70.3 |
| 3N | Cu—28.4Mo—11.6Nb | 71.3 |
| 4N | Cu—48.6Mo—2.4Nb | 65.5 |

TABLE 1A-continued

| Sample | (Infiltration Method) Composition (wt. %) | IACS (%)* |
|---|---|---|
| 5N | Cu—45.3Mo—4.7Nb | 62.8 |
| 6N | Cu—40.5Mo—9.5Nb | 64.0 |
| 7N | Cu—35.7Mo—14.3Nb | 61.3 |
| 8N | Cu—25.7Mo—24.3Nb | 62.2 |
| 9N | Cu—15.5Mo—34.5Nb | 63.7 |
| 10N | Cu—57.2Mo—2.8Nb | 58.2 |
| 11N | Cu—54.4Mo—5.6Nb | 55.3 |
| 12N | Cu—48.7Mo—11.3Nb | 53.6 |
| 13N | Cu—42.9Mo—17.1Nb | 44.1 |
| 14N | Cu—30.8Mo—29.2Nb | 50.4 |
| 15N | Cu—18.6Mo—41.4Nb | 49.8 |

*IACS: International Annealed Copper Standard

TABLE 1B

| Sample | (Infiltration Method) Composition (wt. %) | IACS (%) |
|---|---|---|
| 1R | Cu—50.2Mo | 60.5 |
| 2T | Cu—33.2Mo—6.8Ta | 59.7 |
| 3T | Cu—22.4Mo—17.6Ta | 55.5 |
| 4T | Cu—45.6Mo—4.4Ta | 62.4 |
| 5T | Cu—41.5Mo—8.5Ta | 58.0 |
| 6T | Cu—34.2Mo—15.8Ta | 53.5 |
| 7T | Cu—27.9Mo—22.1Ta | 50.2 |
| 8T | Cu—17.5Mo—32.5Ta | 45.4 |
| 9T | Cu—5.0Mo—45.0Ta | 48.9 |
| 10T | Cu—54.7Mo—5.3Ta | 54.4 |
| 11T | Cu—49.8Mo—10.2Ta | 48.4 |
| 12T | Cu—41.1Mo—18.9Ta | 44.4 |
| 13T | Cu—33.5Mo—26.5Ta | 47.2 |
| 14T | Cu—21.0Mo—39.0Ta | 46.4 |
| 15T | Cu—6.0Mo—54.0Ta | 44.3 |

In the powder sintering method, for example, Mo powder of 3 μm in mean grain size, Nb powder of grain size less than 40 μm and Cu powder of grain size less than 75μm have been mixed in the ratio of 38.1:1.9:60 at weight percentage for two hours. The mixed powder was then filled in dies of prescribed geometry, to be compacted by a press under a pressure of 3.3 ton/cm$^2$. The compact thus formed has been sintered in a hydrogen atmosphere at a temperature just below the melting point of copper for two hours, thereby to obtain a contact material. This contact material is shown as a sample 17N in Table 2A, which lists up the samples of the Cu-Mo-Nb system obtained by the powder sintering method. A sample 16R containing no Nb and a sample 23R of the Cu-Cr system are shown for reference.

Similarly, Table 2B shows samples of the Cu-Mo-Ta system prepared by the powder sintering method. These samples were prepared under the same conditions as those for the Cu-Mo-Nb system contact material.

TABLE 2A

| Sample | (Powder Sintering Method) Composition (wt. %) | IACS (%) |
|---|---|---|
| 16R | Cu—25Mo | 66.9 |
| 17N | Cu—38.1Mo—1.9Nb | 55.5 |
| 18N | Cu—36.2Mo—3.8Nb | 55.0 |
| 19N | Cu—28.6Mo—11.4Nb | 61.3 |
| 20N | Cu—23.8Mo—1.2Nb | 74.9 |
| 21N | Cu—22.6Mo—2.4Nb | 73.6 |
| 22N | Cu—17.9Mo—7.1Nb | 60.6 |
| 23R | Cu—25Cr | 41.8 |

TABLE 2B

| Sample | (Powder Sintering Method) Composition (Wt. %) | IACS (%) |
|---|---|---|
| 16R | Cu—25Mo | 66.9 |
| 17T | Cu—36.5Mo—3.5Ta | 57.0 |
| 18T | Cu—33.2Mo—6.8Ta | 56.4 |
| 19T | Cu—22.4Mo—17.6Ta | 52.0 |
| 20T | Cu—22.8Mo—2.2Ta | 73.7 |
| 21T | Cu—20.7Mo—4.3Ta | 71.2 |
| 22T | Cu—14.0Mo—11.0Ta | 62.2 |
| 23R | Cu—25Cr | 41.8 |

In the hot press method, for example, Mo powder of 3 μm in mean grain size, Nb powder of grain size less than 40 μm and Cu powder of grain size less than 75 μm have been mixed in the ratio of 38.1:1.9:60 at weight percentage for two hours. The mixed powder was then filled in carbon dies to be heated at 1000° C. under a pressure of 200 Kg/cm$^2$ in a vacuum, thereby to obtain a contact material ingot. The contact material thus obtained is shown as a sample 25N in Table 3A, which lists up the samples of the Cu-Mo-Nb system prepared by the hot press method. A sample 24R containing no Nb was prepared for reference.

Similarly, Table 3B shows samples of the Cu-Mo-Ta system prepared by the hot press method. Conditions for preparing the same were identical to those for the samples of the Cu-Mo-Nb system.

TABLE 3A

| Sample | (Hot Press Method) Composition (wt. %) | IACS (%) |
|---|---|---|
| 24R | Cu—25Mo | 76.1 |
| 25N | Cu—38.1Mo—1.9Nb | 62.5 |
| 26N | Cu—36.2Mo—3.8Nb | 62.0 |
| 27N | Cu—28.6Mo—11.4Nb | 68.3 |
| 28N | Cu—23.8Mo—1.2Nb | 75.8 |
| 29N | Cu—22.6Mo—2.4Nb | 75.5 |
| 30N | Cu—17.9Mo—7.1Nb | 72.8 |

TABLE 3B

| Sample | (Hot Press Method) Composition (wt. %) | IACS (%) |
|---|---|---|
| 24R | Cu—25Mo | 76.1 |
| 25T | Cu—36.5Mo—3.5Ta | 72.0 |
| 26T | Cu—33.2Mo—6.8Ta | 61.3 |
| 27T | Cu—22.4Mo—17.6Ta | 54.0 |
| 28T | Cu—22.8Mo—2.2Ta | 75.3 |
| 29T | Cu—20.7Mo—4.3Ta | 73.8 |
| 30T | Cu—14.0Mo—11.0Ta | 71.0 |

Characteristics of Contact Material

The respective samples of the contact materials prepared by the said methods were machined into electrodes of 20 mm in diameter, and then subjected to measurement of electric conductivity. The results are included in Tables 1A, 1B, 2A, 2B, 3A and 3B, and it is obvious that most of the samples are equivalent to or higher than the reference sample 23R of the conventional Cu-Cr contact material in electric conductivity.

The said electrodes were assembled into standard circuit breakers, to be subjected to measurement of electric characteristics. FIG. 1A shows normalized breaking performance of the samples prepared by the infiltration method as shown in Table 1A. The contact materials according to the present invention are of the ternary system, and hence the abscissa indicates the content of Nb with respect to Mo, i.e., the total weight percentage of Mo and Nb is 100%. The ordinate indicates the normalized breaking performance with reference to the conventional Cu - 50 wt. % Mo contact material, i.e., the value of the current breakable through the standard vacuum circuit breaker, with reference to the Cu - 50 wt. % Mo contact material as shown by a double circle 4 in FIG. 1A.

A curve 1 in FIG. 1A represents breaking performance of the Cu-Mo-Nb samples 2N and 3N respectively containing about 60 wt. % Cu as shown in Table 1A. A curve 2 represents breaking performance of the Cu-Mo-Nb samples 4N, 5N, 6N, 7N, 8N and 9N respectively containing about 50 wt. % Cu and the Cu - 50.2 wt. % Mo sample 1R containing no Nb as shown in Table 1A. A curve 3 in FIG. 1A represents breaking performance of the Cu-Mo-Nb samples 10N, 11N, 12N, 13N, 14N and 15N respectively containing about 40 wt. % Cu as shown in Table 1A. A line 5 in FIG. 1A represents breaking performance of the sample 23R of the conventional Cu - 25 wt. % Cr contact material prepared by the powder sintering method for reference.

Figure 1B:
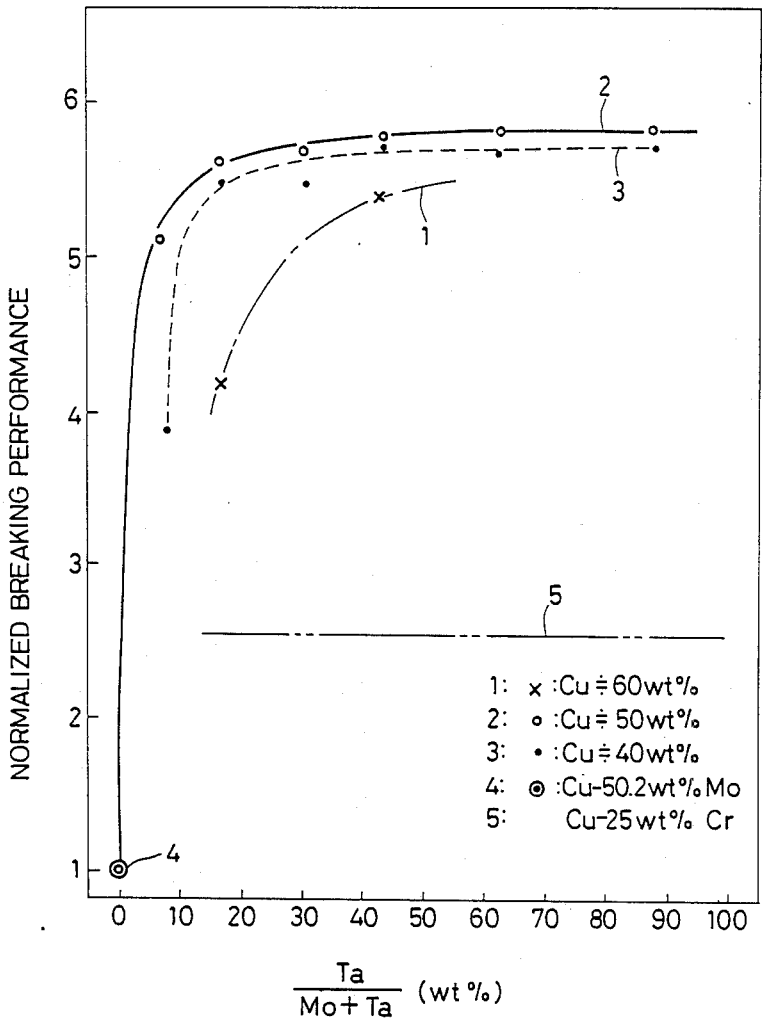

Similarly, FIG. 1B shows breaking performance of the Cu-Mo-Ta contact material prepared by the infiltration method as shown in Table 1B.

As an example of the breaking performance, a current of 12.5 KA at 7.2 KV was satisfactorily broken by the sample 5N or 4T of 20 mm in diameter assembled into the standard vacuum circuit breaker.

It is understood from FIGS. 1A and 1B that the contact materials of the Cu-Mo-Nb and Cu-Mo-Ta systems prepared by the infiltration method is superior in breaking performance to the conventional Cu-Cr contact material. In the infiltration method, the samples were prepared within the range of 2.4–41.4 wt. % Nb and 15.5–57.2 wt. % Mo, or 4.4–54.0 wt. % Ta and 5.0–54.7 wt. % Mo. With respect to the contact materials being superior in breaking performance to the conventional Cu-Cr contact material, it is believed that contents of Mo and Nb, or Mo and Ta may be in wider ranges. However, increase in the contents of Ta, Nb and Mo generally involves increased cost and deteriorated machinability. Therefore, optimum compositions can be selected in consideration of electric characteristics as well as cost and mechanical characteristics.

Figure 2A:
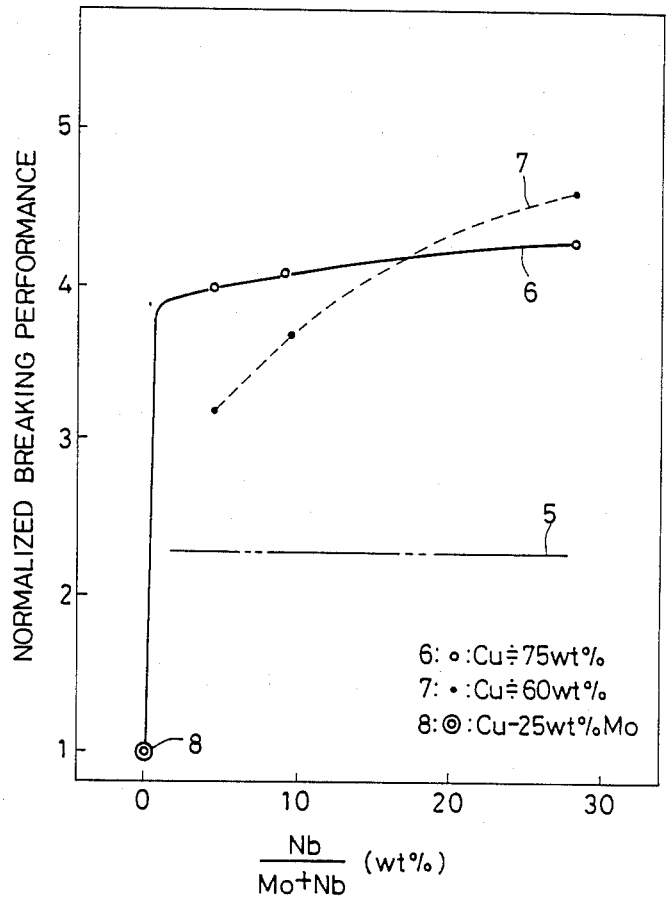
FIGS. 2A and 2B are graphs respectively showing normalized breaking performance of Cu-Mo-Nb and Cu-Mo-Ta contact materials prepared by a powder sintering method in accordance with the present invention.

FIG. 2A shows normalized breaking performance of the Cu-Mo-Nb samples prepared by the powder sintering method as listed in Table 2A. In FIG. 2A, the abscissa indicates the Nb content with respect to Mo similarly to FIG. 1A, while the ordinate indicates the breaking performance with reference to a contact material of Cu - 25 wt. % Mo (sample 16R) as shown by a double circle 8. A curve 6 represents breaking performance of samples 20N, 21N, 22N and 23N of the Cu-Mo-Nb contact material respectively containing about 75 wt. % Cu and the reference sample 16R as shown in Table 2A. A curve 7 in FIG. 2A represents breaking performance of the samples 17N, 18N and 19N of the Cu-Mo-Nb system respectively containing about 60 wt. % as shown in Table 2A. A line 5 in FIG. 2A represents breaking performance of conventional Cu - 25 wt. % Cr contact material for reference, similarly to FIG. 1A.

Figure 2B:
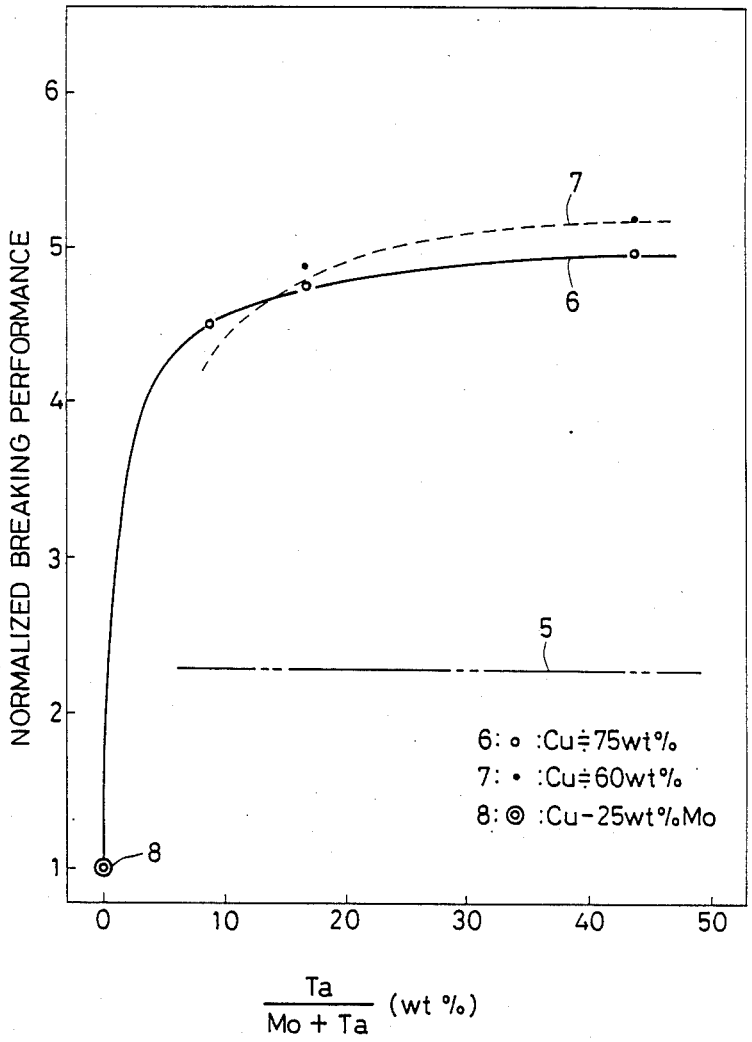

In a similar manner, FIG. 2B shows breaking performance of the Cu-Mo-Ta contact material prepared by the powder sintering method as shown in Table 2B.

It is understood from FIGS. 2A and 2B that the contact materials of the Cu-Mo-Nb and Cu-Mo-Ta systems prepared by the powder sintering method are also superior in breaking performance to the conventional Cu-Cr contact material. While compositions of the contact materials prepared by the powder sintering method were within the ranges of 1.2–11.4 wt. % Nb and 1.79–38.1 wt. % Mo, or 2.2–11.0 wt. % Ta and 1.40–36.5 wt. % Mo, the contact materials in wider ranges of these contents are believed to be superior in breaking performance to the conventional Cu-Cr contact material.

Figure 3A:
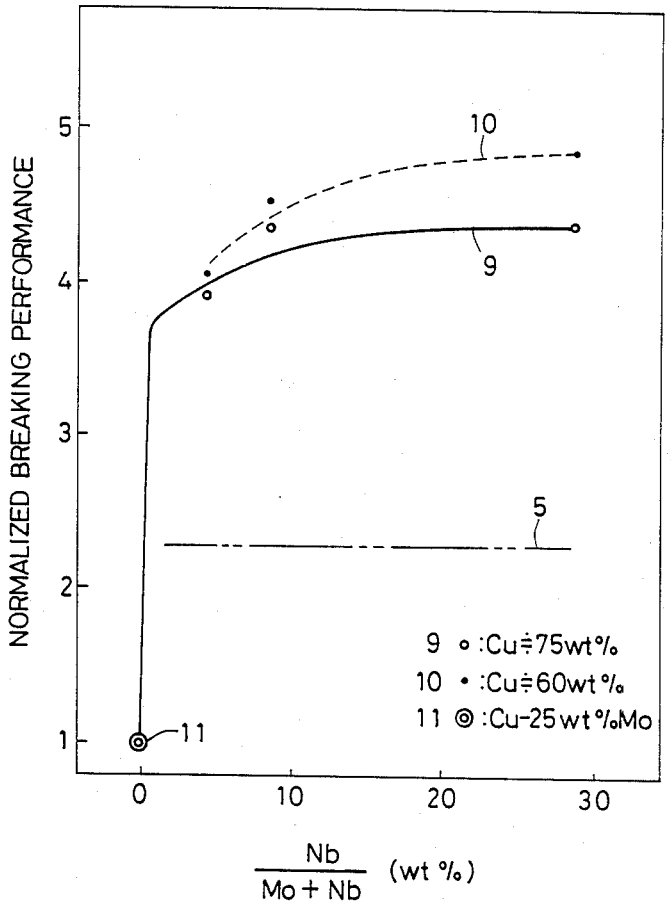
FIGS. 3A and 3B are graphs showing normalized breaking performance of Cu-Mo-Nb and Cu-Mo-Ta contact materials prepared by a hot press method in accordance with the present invention.

FIG. 3A shows breaking performance of the contact material prepared by the hot press method as shown in Table 3A. Similarly to FIG. 1A, the abscissa indicates the Nb content with respect to Mo. The ordinate indicates the breaking performance with reference to a contact material of Cu - 25 wt. % Mo (sample 24R) prepared by the hot press method, with the reference being shown by a double circle 11. A curve 9 in FIG. 3A represents the breaking performance of the Cu-Mo-Nb samples 28N, 29N and 30N respectively containing about 75 wt. % Cu and the reference sample 24R as shown in Table 3A. A curve 10 represents the breaking performance of samples 25N, 26N and 27N respectively containing about 60 wt. % Cu as shown in Table 3A. Similarly to FIG. 1A, a line 5 represents the breaking performance of the conventional contact material of Cu - 25 wt. % Cr (sample 23R) for reference.

Figure 3B:
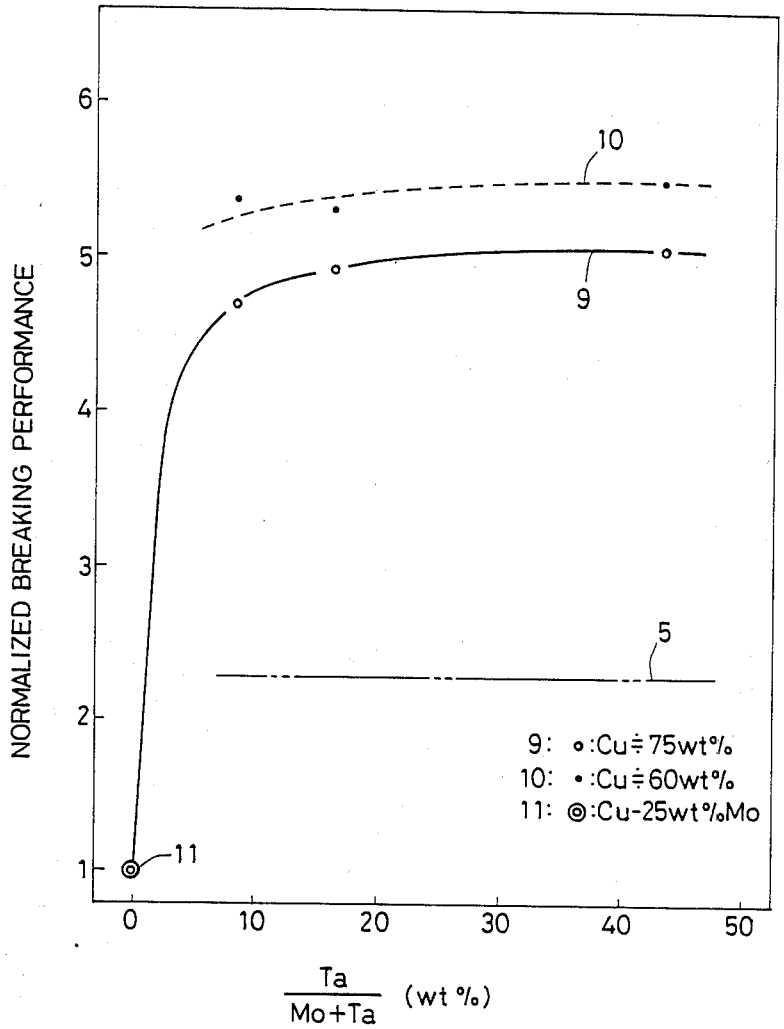

In a similar manner, FIG. 3B shows breaking performance of the Cu-Mo-Ta contact material prepared by the hot press method as shown in Table 3B.

It is understood from FIGS. 3A and 3B that the contact materials of the Cu-Mo-Nb and Cu-Mo-Ta systems prepared by the hot press method are also superior in breaking performance to the conventional Cu-Cr contact material. Similarly to Tables 2A and 2B, compositions of the contact material prepared by the hot press method were within the ranges of 1.2–11.4 wt. % Nb and 17.9–38.1 wt. % Mo, or 2.2–11.0 wt. % Ta and 14.0–36.5 wt. % Mo, but the contact materials of these systems in wider ranges of the contents are believed to be superior in breaking performance to the conventional Cu-Cr contact material.

Referring to the curves 1, 7 and 10 in FIGS. 1A, 2A and 3A, comparison can be made on the Cu-Mo-Nb samples containing about 60 wt. % Cu prepared by different methods, whereas no remarkable difference is observed except for that the samples prepared by the hot press method are somewhat better in breaking performance than the other samples. While the samples of the Cu-Mo-Nb contact material were investigated within the ranges of 15.5–57.2 wt. % Mo and 1.2–41.4 wt. % Nb, the breaking performance thereof is believed to be excellent in a wider range of the Nb content, since the performance is increased with increase of the Nb content in each of FIGS. 1A, 2A and 3A. Although the Cu-Mo-Nb samples containing 40 wt. % Cu are lower in breaking performance in certain ranges of the Mo and Nb contents than the other Cu-Mo-Nb samples in FIG. 1A, the same are sufficiently applicable in practice since the breaking performance is increased with increase of the Nb content.

Similarly, comparison can be made on the Cu-Mo-Ta samples containing about 60 wt. % Cu prepared by different methods, with reference to the curves 1, 7 and 10 as shown in FIGS. 1B, 2B and 3B. However, only slight difference in breaking performance is observed between the samples. Although the Cu-Mo-Ta samples were investigated within the range of 5.0–54.7 wt. % Mo and 2.2–54.0 wt. % Ta, the contact material containing a higher content of Ta is believed to be excellent in breaking performance since the breaking performance is increased with increase of Ta content in each of FIGS. 1B, 2B and 3B.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. Contact material for vacuum circuit breaker which contains elements of: (1) copper; (2) molybdenum; and (3) niobium or tantalum.

2. Contact material for vacuum circuit breaker in accordance with claim 1, wherein said contact material contains (1) more than 15 wt. % molybdenum and more than 1 wt. % niobium, or (2) more than 5 wt. % molybdenum and more than 2 wt. % tantalum.

3. Contact material for vacuum circuit breaker in accordance with claim 1, wherein said contact material contains (1) 15–60 wt. % molybdenum and 1–45 wt. % niobium, or (2) 5–55 wt. % molybdenum and 2–55 wt. % tantalum.

4. Contact material for vacuum circuit breaker in accordance with claim 1, wherein said elements are dispersed in a state of simple substances thereof, alloys containing at least two of said elements or intermetallic compounds containing at least two of said elements, or as a composite of said states.

5. Contact material for vacuum circuit breaker in accordance with claim 1, wherein said contact material is prepared by an infiltration method, which is one of methods of applied powder metallurgy.

6. Contact material for vacuum circuit breaker in accordance with claim 1, wherein said contact material is prepared by a powder sintering method.

7. Contact material for vacuum circuit breaker in accordance with claim 1, wherein said contact material is prepared by a hot press method, which is one of methods of applied powder metallurgy.

* * * * *